United States Patent [19]

Suarez

[11] Patent Number: 4,516,775

[45] Date of Patent: May 14, 1985

[54] BASEBALL GAME

[76] Inventor: Benjamin D. Suarez, 2000 - 49th St., NW., Canton, Ohio 44709

[21] Appl. No.: 568,054

[22] Filed: Jan. 4, 1984

[51] Int. Cl.[3] ..... A63F 7/06

[52] U.S. Cl. ..... 273/89

[58] Field of Search ..... 273/89, 90

[56] References Cited

U.S. PATENT DOCUMENTS

| | | | |
|---|---|---|---|
| 918,799 | 4/1909 | Uhrland | 273/89 |
| 961,714 | 6/1910 | Chase | 273/89 |
| 1,092,979 | 4/1914 | Dengler . | |
| 1,157,913 | 10/1915 | Twibell | 273/89 |
| 1,299,304 | 4/1919 | Cramer . | |
| 1,380,440 | 6/1921 | Tosso | 273/89 |
| 1,687,800 | 10/1928 | Smith | 273/89 X |
| 1,703,628 | 2/1929 | Laesch . | |
| 1,944,685 | 3/1935 | Callejas | 273/89 |
| 2,026,791 | 1/1936 | Mayer | 273/90 |
| 2,053,170 | 9/1936 | Wood | 273/89 |
| 2,276,457 | 3/1942 | Bock | 273/89 |
| 2,308,816 | 1/1943 | Lamar . | |
| 2,325,858 | 8/1943 | Kellermann | 273/89 |
| 2,344,193 | 3/1944 | Woodward | 273/90 |
| 2,462,170 | 2/1949 | Dube | 273/90 |
| 2,829,895 | 4/1958 | Moen | 273/89 X |
| 3,358,997 | 12/1967 | Belz | 273/89 |
| 3,534,962 | 10/1970 | Singleman . | |
| 3,854,720 | 12/1974 | Duvall . | |
| 3,879,037 | 4/1975 | Cooke | 273/89 |
| 4,017,074 | 4/1977 | Roberts | 273/89 |

*Primary Examiner*—Paul E. Shapiro

*Attorney, Agent, or Firm*—Michael Sand Co.

[57] ABSTRACT

An improved baseball game that is played by two or more players within a limited space in a room that closely simulates real baseball. One player manipulates a bat which is pivotally mounted on a base that is located within a transparent enclosure and attempts to strike a ball propelled by a hand manipulated wand operated by another player at a pitching station located outside of the enclosure. The balls move through an opening formed in an end wall of the enclosure and down an inclined surface toward the bat. A backstop will signal whether an unbatted ball is a ball or strike. A ramp within the enclosure directs a batted ball toward a plurality of ball receiving compartments which designates whether a hit or out has been achieved. A transparent shield is located at the pitching station for protecting the pitcher from being struck by a batted ball passing through the opening in the end wall of the enclosure.

24 Claims, 16 Drawing Figures

BASEBALL GAME

TECHNICAL FIELD

The invention relates to a baseball game adapted to be played by two players which requires skill, reflexes, hand-to-eye coordination and thinking strategy as in a real baseball game. More particularly the invention relates to a baseball game in which one of the players pitches a simulated baseball toward the batter who uses his skill and strategy to hit the pitched ball and outguess the pitcher as to the type of pitch to be delivered to the batter.

BACKGROUND ART

A considerable number of baseball games of the type which are played on a table top or in a self-supporting unit have been devised to provide the players with a device which resembles the real game of baseball as closely as possible within a limited area. These prior games are of various configurations and constructions and use mechanisms to enable the game to resemble and simulate actual baseball as closely as possible.

Some of these games are provided with a movable member which simulates a bat and is moved by one of the players to hit a ball into a specific area of the playing field, which depending on the area in which the ball comes to rest will indicate whether a "hit" or "out" or other type of baseball play has occurred. Other prior baseball games use various types of bumpers and obstructions which are contacted by the batted ball affecting the final destination of the ball. Still other types of simulated games have used an inclined ramp which the ball can roll along and come to rest in other portions of the playing field to simulate a particular type of baseball play. Still other of these games provide a means in which another player will roll a ball toward the batter to simulate a pitch or will drop the ball onto the playing field which will roll along an inclined surface toward a home plate area and the batter's position.

Examples of these types of games can be found in one or more of the following patents:

| | | |
|---|---|---|
| 853,463 | 1,783,338 | 2,775,457 |
| 1,092,979 | 1,850,778 | 3,050,308 |
| 1,299,304 | 2,308,816 | 3,111,318 |
| 1,384,095 | 2,344,193 | 3,534,962 |
| 1,640,878 | 2,412,714 | 3,854,720 |
| 1,703,628 | 2,749,122 | 3,913,915 |
| | | D-112,644 |

Although these various prior baseball games do simulate in many respects a baseball game, they lack one main feature, that is, the speed and versatility of a pitched ball being projected toward another player equipped with a simulated bat for striking the same. In all of these prior constructions, the ball is slowly rolled or directed toward the batter with less simulated speed than occurs in a real baseball game. Therefore, in these prior baseball games, the batter will usually be able to hit the pitched ball without difficulty eliminating a major portion of a baseball game which involves the skill of the batter and pitcher in head-to-head confrontation.

Therefore, the need has existed for a baseball game which more closely resembles actual baseball in which one of the players delivers a ball towards home plate and a movable bat operated by another player at various speeds and directions to more closely simulate an actual pitch delivered by a baseball pitcher. There is no such baseball game of which I am aware which provides this feature in addition to the other unique features described in greater detail below.

DISCLOSURE OF THE INVENTION

Objectives of the invention include providing an improved baseball game construction adapted to be played by two players on a table top or other supporting structure in a relatively minimum amount of space, yet which provides a fast action physical game with most of the playing field being in a protective enclosure eliminating any possible injury to the players or damage to the surrounding area. Another objective is to provide such a baseball game in which the enclosure is formed of transparent high strength plastic enabling the field of play and ball movement to be seen at all times, in which one of the players actually and physically hand control pitches a ball toward the batter with a high degree of skill and strategy, in which the pitcher can develop sufficient skill to hit the corners of the home plate and change speeds of pitch delivery to outwit the opposing player manipulating the bat.

Another objective of the invention is to provide such a baseball game in which a second player simulates the batter and physically moves a hand-controlled bat which requires hand skill reflexes and hand-to-eye coordination to strike the ball being pitched by the other player at considerable and varying speeds, and in which the batter can develop sufficient skill to be able to hit the ball in the desired direction to achieve the best possible results, such as a home run, triple, etc. Another objective is to provide such a baseball game in which a backstop is provided behind home plate whereby the ball upon passing the batter automatically and exactly indicates whether the delivered pitch was a ball or strike by the sound that the ball makes upon hitting the backstop; and in which the backstop also collects all pitches and keeps the pitched balls from bouncing back onto the field of play and diverts them to a ball return reservoir at the pitcher's end of the game.

Still another objective of the invention is to provide such a baseball game having a controlled field which absorbs the energy of all hit balls and scales the hit to a precise location and calibration to closely simulate the effect of the batted ball either as a hit or out as in a real baseball game, which diverts balls hit in the direction of the pitcher to an upper scoring plane by a deflection ramp, which ramp diverts all hit balls to a destination depending upon the direction and power of the hit just like in actual baseball, and provides exact precision calibrated scoring of all hits as outs, singles, doubles, triples or home runs, and in which the game is calibrated to big league baseball batting averages of between 0.200 to 0.300 and to the earned run averages of the pitchers (ERAs) between 1.80 and 6.00, the exact percentages of which will be depended upon the skill of the players playing the game. A further objective is to provide such a game in which all balls no matter where pitched or hit, return to a ball reservoir near the pitcher which helps speed up the game and create constant uninterrupted action, and which eliminates the slowness and no action problem of a regular baseball game.

Still another objective of the invention is to provide such an improved baseball game in which a quick tabulating baseball scoreboard is provided without electronics and which quickly keeps track of all phases of the game quickly and easily and without thinking or game interruption. A further objective is to provide such a baseball game which can be shipped in a collapsed, compact condition reducing packaging, storage and shipping cost, and which can be assembled easily by a purchaser after shipment and dismantled for compact storage when not in use. Another objective is to provide such a baseball game in which the bat can be positioned on both sides of the home plate depending upon a particular batter being right or left handed, and in which the pitched ball can be pitched to simulate either a left or right-handed pitcher; and in which the invention provides an improved baseball game which eliminates difficulties and disadvantages existing with prior games, solves problems, satisfies needs and obtains new results in the art.

These objectives and advantages are obtained by the improved baseball game construction of the invention, the general nature of which may be stated as including: a base; a generally transparent enclosure mounted on the base; inclined surface means mounted on the base and extending upwardly outwardly beyond the enclosure for forming a ball delivery path and a pitching station at an outer end thereof; a pivotally mounted bat located adjacent an inner end of the inclined surface means adapted to be manually moved by one of the players for striking a ball propelled by the other player; a ball adapted to be propelled by the other player from the pitching station along the ball delivery path of the inclined surface means toward the bat; a hand manipulated wand adapted to be operated by said other player for propelling the ball toward the bat; a plurality of elevated ball receiving compartments located within the enclosure for capturing a batted ball, with certain of the compartments designating a particular type of a hit; and ramp means located within the enclosure for directing a ball struck by the bat outwardly toward the compartments.

BRIEF DESCRIPTION OF THE DRAWINGS

A preferred embodiment of the invention, illustrative of the best mode in which the applicant has contemplated applying the principles, is set forth in the following description and shown in the drawings and is particularly and distinctly pointed out and set forth in the appended claims.

FIG. 1;

FIG. 2;

FIG. 1;

FIG. 1 showing the bat stop;

FIG. 5;

FIG. 5;

FIG. 5;

FIG. 5;

FIG. 6;

Similar numerals refer to similar parts throughout the drawings.

BEST MODE FOR CARRYING OUT THE INVENTION

Figure 12:
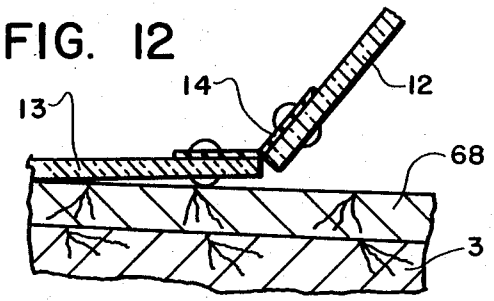
FIG. 12 is an enlarged fragmentary sectional view taken on line 12—12.
Figure 3:
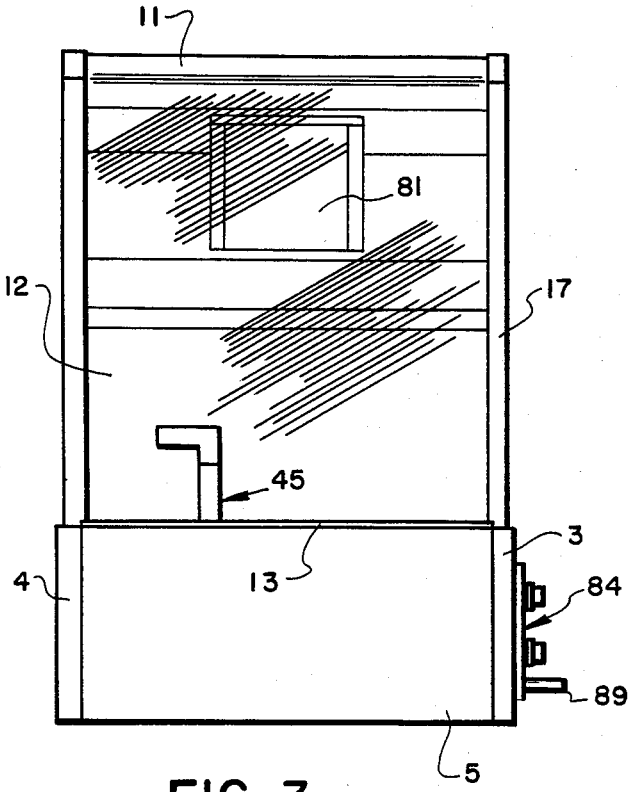
FIG. 3 is a front elevational view of the baseball game of FIGS. 1 and 2.
Figure 4:
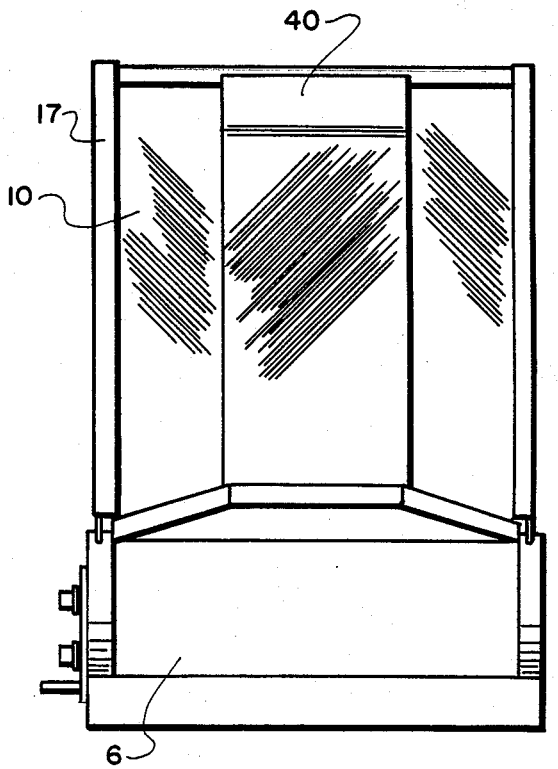
FIG. 4 is a rear elevational view of the baseball game of FIGS. 1, 2 and 3.

The improved baseball game is indicated generally at 1, and is shown particularly in FIGS. 1-5. Game 1 includes a supporting base indicated generally at 2, formed by a pair of vertical sidewalls 3 and 4, a front wall 5 and a stepped horizontally offset rear wall 6. A transparent enclosure indicated generally at 7, is mounted on supporting base 2 and includes a pair of side panels 8 and 9, a rear panel 10, a top generally horizontal panel 11, and a sloped front panel 12 which terminates in a horizontal pivotally mounted panel 13. Panel 13 is pivotally mounted by a hinge 14 (FIGS. 1 and 12) on sloped panel 12. Panel 13 extends transversely across support base 2 between sidewalls 3 and 4 and is formed with a rectangular-shaped slot 15 at the hinged end thereof adjacent sloped panel 12.

Figure 15:
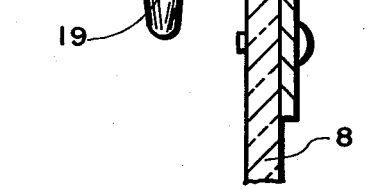
FIG. 15 is an enlarged fragmentary sectional view taken on line 15—15, FIG. 1.
Figure 6:
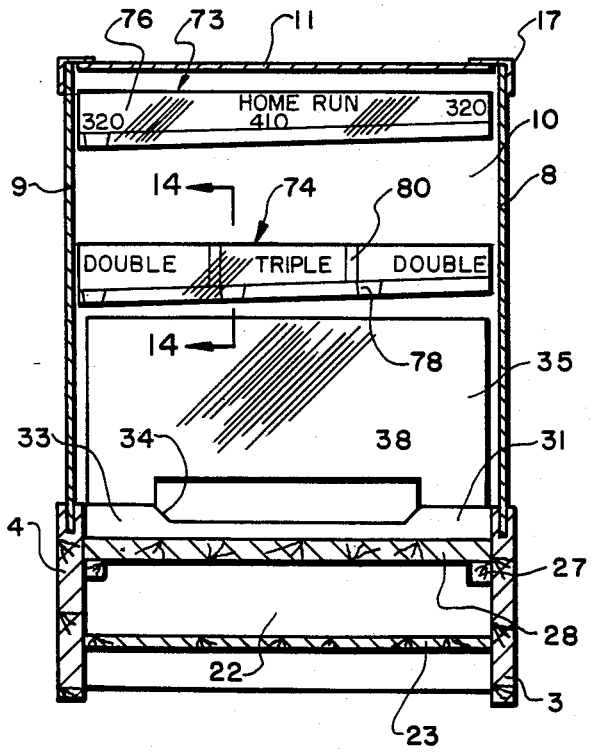
FIG. 6 is a vertical sectional view taken on line 6—6.
Figure 13:
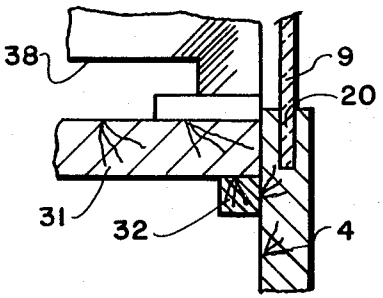
FIG. 13 is an enlarged fragmentary sectional view taken on line 13—13.

Panels 8, 9, 10, 11 and 12 of enclosure 7 preferably are joined by L-shaped metal strips 17 and a plurality of manually inserted retaining rivets 18 spaced along strips 17 and the various enclosure panels (FIG. 15). The bottom edges of the panels are inserted in grooves 20 formed in the top edges of base sidewalls 3 and 4 and rear wall 6 (FIGS. 6 and 13). This construction of enclosure 7 enables the panels and strips 17 to be shipped in a disassembled, compact condition and erected by the purchaser of the game easily by inserting rivets 18 through predrilled holes 19 formed in the metal strips and enclosure panels. Panels 8 through 13 are formed of a high strength polycarbonate plastic material, such as Lexan which is a trademarked product of General Electric Company. This construction provides a clear, high strength panel which enables the interior of enclosure 7 to be viewed easily, and which is scratch and mar resistant to provide a safe, effective and pleasing appearance to the game even after long periods of storage and use.

Figure 5:
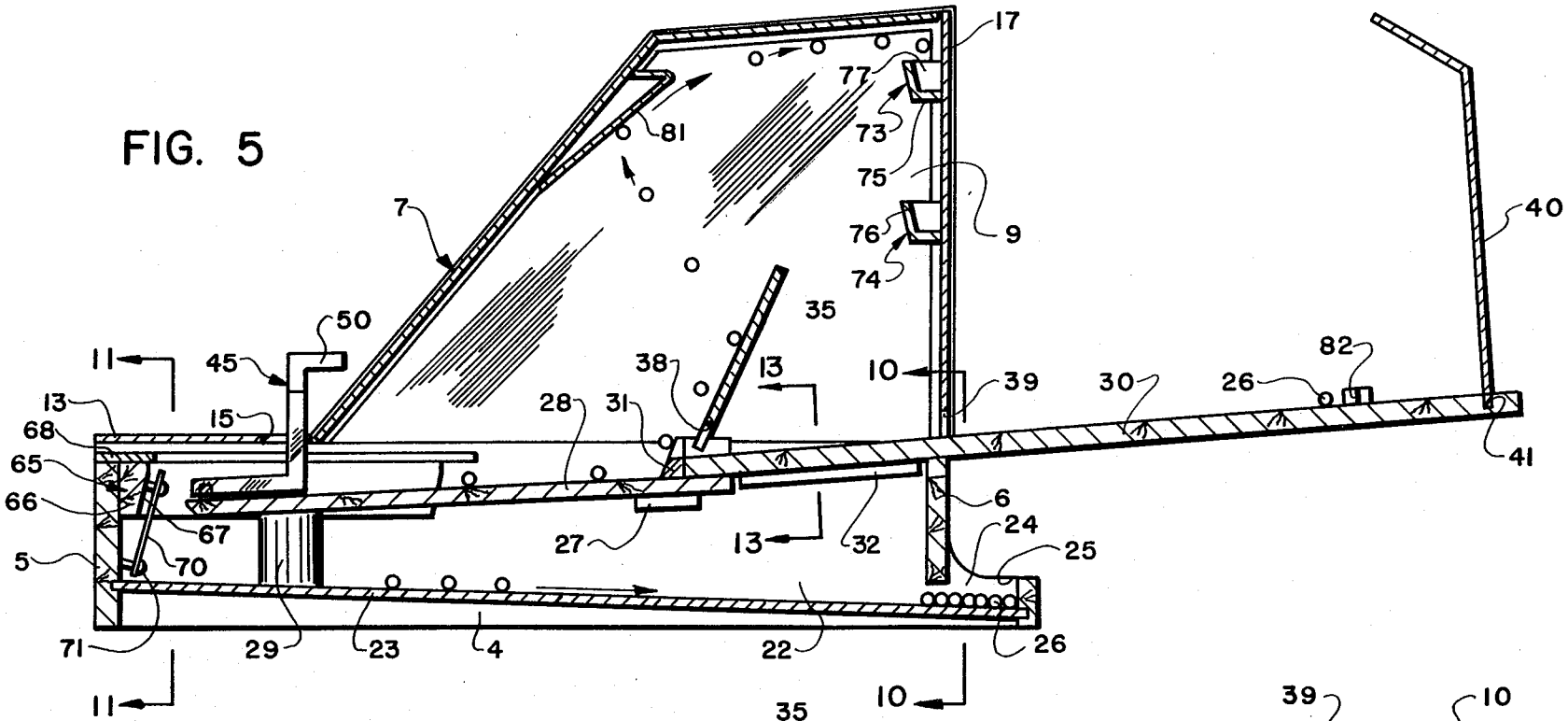
FIG. 5 is a longitudinal sectional view taken on line 5—5.

Base 2 forms a hollow interior 22 having a bottom wall 23 which extends transversely between sidewalls 3 and 4 and which is sloped downwardly from front wall 5 toward a ball collection area 24 formed at the lower portion of stepped rear wall 6 as shown in FIG. 5 to provide a ball return surface for all balls pitched and struck by the bat. Bottom wall 23 terminates beyond the upper portion of rear wall 6 and forms ball collection area 24 which is accessible through an opening 25 which extends between sidewalls 3 and 4 throughout the length of rear wall 6. This arrangement enables the player assuming the pitcher's position to have easy access to a plurality of balls for continuous playing of the game.

In accordance with another feature of the invention, a simulated infield surface is formed on base 2 within enclosure 7 by a flat smooth panel 28. Panel 28 is supported above bottom wall 23 and by a post 29 and a brace 27 (FIG. 5). Infield panel 28 extends upwardly rearwardly at an inclined angle of approximately $3\frac{1}{2}°$ with respect to the horizontal and extends from a position closely adjacent to but spaced from front wall 5 to a location generally midway within enclosure 7.

Figure 10:
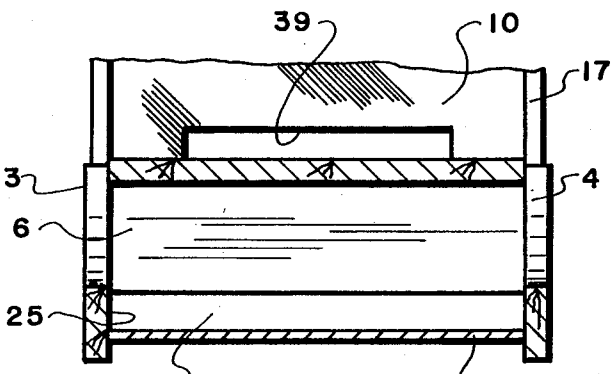
FIG. 10 is a fragmentary sectional view taken on line 10—10.

Another smooth flat panel 30, referred to as the ball delivery surface, is supported by the top edge of rear wall 6 and by a block 31 and a brace 32 on base 2 and extends upwardly rearwardly from infield panel 28. Panel 30 is mounted at an angle of approximately $4\frac{1}{2}°$ with respect to the horizontal. Ball delivery panel 30 extends beyond rear wall 6 and rear enclosure panel 10 as shown particularly in FIGS. 1, 2 and 5. Mounting block 31 is formed with a sloped front surface 33 (FIGS. 5 and 6) and has a cutout 34 formed in the central portion thereof. In addition to joining infield panel 28 and ball delivery panel 30, block 31 also supports a ramp 35. Ramp 35 extends generally transversely across the entire width of enclosure 7 as shown in FIG. 6 and extends upwardly rearwardly therefrom and forms an included angle of approximately 65° with respect to the horizontal. Ramp 35 is formed of a clear high strength plastic material as are the panels of enclosure 7 and has a central opening 38 formed therein. Rear panel 10 (FIG. 10) also is formed with a rectangular-shaped opening 39 at the bottom thereof which aligns with ramp opening 38 through which a pitched ball passes as it moves along panel 30 and enters enclosure 7.

A protective shield 40 is removably mounted in a groove 41 extending transversely across the outer end of panel 30 to protect the pitcher from a ball being struck and propelled outwardly of enclosure 7 through ramp opening 38 and rear panel opening 39. Protective shield 40 is formed of the same clear tough plastic material as is ramp 35 and the enclosure panels.

Figures 1, 8, 9, 16:
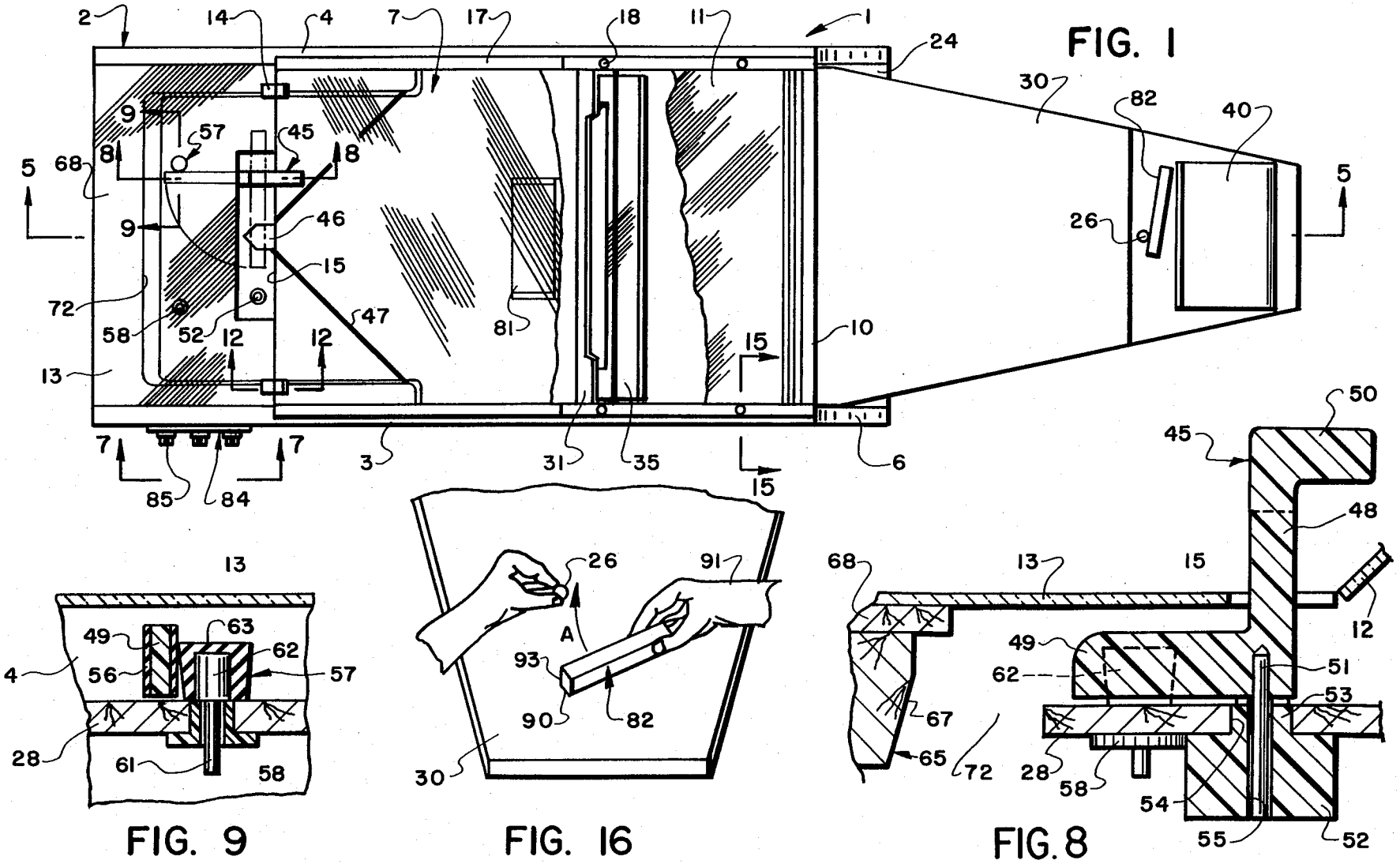
FIG. 1 is a top plan view with portions broken away of the improved baseball game construction.
FIG. 8 is an enlarged fragmentary sectional view taken on line 8—8, FIG. 1 showing the batting mechanism.
FIG. 9 is an enlarged fragmentary sectional view taken on line 9—9.
FIG. 16 is a diagrammatic fragmentary top plan view showing the means of delivering a ball by one of the players toward the batter.

In accordance with another feature of the invention, a manually actuated bat indicated generally at 45, is pivotally mounted at the front end of infield panel 28 adjacent a simulated home plate 46 formed on panel 28 adjacent the end thereof together with two simulated foul lines 47 (FIG. 1). Bat 45 (FIG. 8) has a generally Z-shaped configuration and includes a vertical portion 48 which terminates in a transversely extending ball striking bottom portion 49 and a transversely extending top handle portion 50 which is manually grasped by the batter for rotating the bat on a pivot pin 51. Bat 45 projects upwardly from panel 28 through slot 15 of panel 13.

Pin 41 is embedded in vertical portion of bat 45 and is pivotally mounted in a central opening 55 of a mounting block 52. Block 52 is secured to the bottom of panel 28 having a reduced neck portion 53 which extends into a hole 54 formed in panel 28. Pivot pin 51 preferably is formed of stainless steel which provides a low friction engagement with mounting block 52 which preferably is formed of a high strength plastic material as is bat 45. The flat surfaces of bat striking portion 49 of bat 45 preferably have a resilient coating 56 of rubber bonded thereon. Pivot mounting block 52 is positioned adjacent home plate 46 so that the ball striking portion 49 of bat 45 will move across home plate 46 at the midpoint thereof as shown in dot-dash lines in FIG. 1 as would occur with an actual bat swung by a batter in a regular baseball game.

A stop indicated generally at 57 (FIG. 9), is mounted behind home plate and bat mounting block 52 to limit the bat to a single revolution and preventing it from being continuously rotated. Stop 57 includes a shaft 61 which terminates in an enlarged head 62 and is removably mounted in a hub 58. Hub 58 is mounted in an opening 59 formed in infield panel 28 and has a central opening 60 in which shaft 61 is inserted. Shaft head 62 preferably has a resilient cap 63 or coating formed thereon. Stop 57 as shown in FIG. 1, determines the starting position of the bat by limiting the amount of back swing permitted to the proper amount. Furthermore, stop 57 will stop the forward motion of the bat after it moves across home plate 46 in attempting to strike a pitched ball. Stop 57 will prevent the batter from wildly rotating the bat during the delivery of the pitch since such action does not simulate the actual playing of baseball.

In accordance with another feature of the invention, another bat mounting block 52 and stop hub 58 are mounted on the other side of home plate 46 as shown in FIG. 1. This enables the bat and associated stop to be mounted on either side of home plate 46 to simulate right and left-handed batters as occur in the actual playing of baseball. Bat 45 is merely removed from its mounting in block 52 through slot 15 of pivotally mounted panel 13 after which panel 13 may be pivoted upwardly toward sloped panel 12 permitting stop 57 to be removed and reinstalled in the opposite hub 58. Bat 45 is then repositioned in the other mounting block 52 after closure of panel 13.

Figure 11:
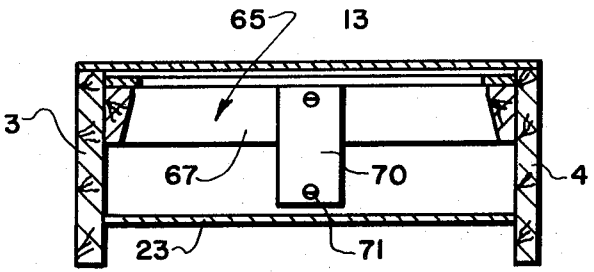
FIG. 11 is a sectional view taken on line 11—11.

Another feature of the invention is an improved backstop indicated generally at 65. Backstop 65 (FIGS. 5 and 11) includes a block 66 preferably formed of wood, which is mounted on the inside surface of front wall 5 of base 2 which has a downwardly inwardly extending sloped surface 67. Block 66 is mounted beneath a U-shaped top wall 68 of base 2 which is mounted on the top of end wall 5 and extends along a portion of base sidewalls 3 and 4. U-shaped wall 68 forms a rest for pivotally mounted closure panel 13 and provides strength and rigidity to base 2.

A strike plate 70 is mounted by a pair of screws 71 on backstop block 66 and front wall 5 as shown in FIG. 5, and projects downwardly and inwardly toward wall 5. Strike block 70 preferably is formed of metal or other material which will provide a distinctive sound when struck by a ball 26 in contrast to the sound produced when ball 26 strikes block 66. The width of strike plate 70 corresponds to the width of home plate 46 and is located in line with plate 46 and the center line of ball delivery panel 30 (FIG. 1). Thus a ball 26 crossing over plate 46 or located within the "strike zone" if not struck by bat 45, will hit plate 70 providing a distinctive sound indicating to the players that the pitched ball was a "strike". Other balls not crossing the home plate will contact block 66 providing a different sound indicating that the pitched ball was a "ball". All balls 26 striking backstop 65, whether block 66 or striking plate 70, will be deflected downwardly into the interior 22 of base 2, through an elongated opening 72 formed between backstop 65 and the front edge of infield panel 28. The balls will roll along bottom wall 23 to the ball collection area 24 adjacent rear wall access opening 25.

Figure 14:
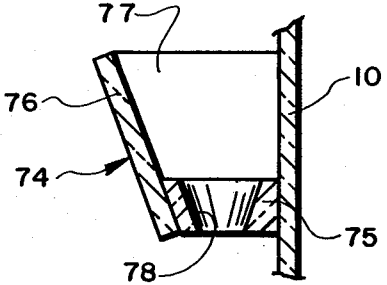
FIG. 14 is an enlarged fragmentary sectional view taken on line 14—14.

A pair of shelves 73 and 74 are mounted on rear panel 10 and extend transversely between side panels 8 and 9. Each shelf is formed with a horizontal bottom wall 75 and a outwardly extending front wall 76 spaced from rear panel 10 forming a ball receiving area 77 therebetween. Bottom walls 75 are sloped toward one side of each shelf whereby a batted ball entering the shelf will roll along the bottom wall toward the end most position where the ball drops through a hole 78 which is formed in the bottom wall (FIG. 14). The ball will move down through the hole and onto ball delivery panel 30 where it will roll downwardly across panel 30 through ramp opening 38 and then across infield panel 28 until dropping off the end of panel 28 and onto bottom wall 23 where it will roll into ball collection area 24.

Upper shelf 73 is designated as the "home run" shelf and has a single hole 78. Thus any batted ball lodging in shelf 73 will constitute a home run. Lower shelf 74 has a pair of partitions 80 which divide the shelf into a pair of spaced "double" compartments and a center "triple" compartment. A hole 78 is formed at the lower end of each compartment so that a batted ball coming to rest in the respective double or triple compartments will fall through the respective hole and onto the playing surface below. The size of holes 78 are slightly larger than the diameter of balls 26 which enable the ball to drop through the hole, yet will retain the ball sufficiently long in the slope contour of the hole to enable the players to easily see where the batted ball came to rest prior to the ball dropping to the lower playing surface.

A ball deflector 81 is mounted on the inside surface of sloped panel 12 of enclosure 7 so that certain batted balls moving up ramp 35, depending upon the velocity with which they were hit by bat 45, will strike deflector 81 and be directed toward shelves 73 and 74 for possible capture therein as shown diagrammatically in FIG. 5. A batted ball landing beyond ramp 35 and not in one of the shelves 73 and 74 would constitute a "single" whereas any balls not passing beyond ramp 35 would constitute an "out".

In accordance with one of the main and distinguishing features of applicant's invention over prior baseball games is the means by which a ball 26 is delivered to the batter. A player sitting or standing behind shield 40 at the end of ball delivery panel 30 manually moves a pitching wand 82 in a manner as shown in FIG. 16. A ball 26 is released forwardly of wand 82 and by a rapid sliding pivotal like motion of wand 82 by the other hand of the player the ball will be struck and propelled extremely rapidly along panel 30 through rear panel opening 39 and through ramp opening 38 and across infield panel 28 towards the batter's area adjacent home plate 46. Sufficient skill can be developed whereby the ball can be propelled up to or even sometimes greater than 95 mph and can be directed to various portions of the batting area. Thus the pitcher can delibrately throw balls or near strikes to entice the batter to actuate bat 45 in an attempt to strike the ball. Furthermore, the delivery speed of a pitched ball can be varied considerably attempting to outwit the batter who upon expecting a fast ball will swing prematurely if a slower ball is delivered by the other player with wand 82.

Wand 82 preferably is formed of wood or a hard plastic material and may be coated with a resilient material. It has been found that balls 26 provide the desired pitching and hitting characteristics to more closely resemble actual baseball game conditions if formed of a solid synthetic resin polymer such as polytetrafluoroethylene which is sold under the trademark Teflon by Dupont. Balls 26 preferably have a one-half inch diameter and weigh approximately 2.5 grams.

The pitched ball is attempted to be struck by the other player by pivoting bat 45. The batter may elect not to swing at a particular pitch which depending upon its path crossing home plate 46 will either hit strike plate 70 indicating a "strike" or will hit block 66 indicating that the pitch was a "ball". The batter upon hitting the ball will propel it within enclosure 7 resulting in the ball either traveling along ramp 35 and into a hit shelf 73 or 74 or dropping into the single's area behind ramp 35 or remaining in the forward portion of enclosure 7 between bat 45 and ramp 35 signaling that the hit ball was an "out". All balls whether hit or not will be returned to ball collection area 24 by rolling along panels 30 and 28 to the lower end thereof where they drop downwardly onto bottom wall 23 of base 2 through opening 72 as shown in FIG. 5

Figure 2:
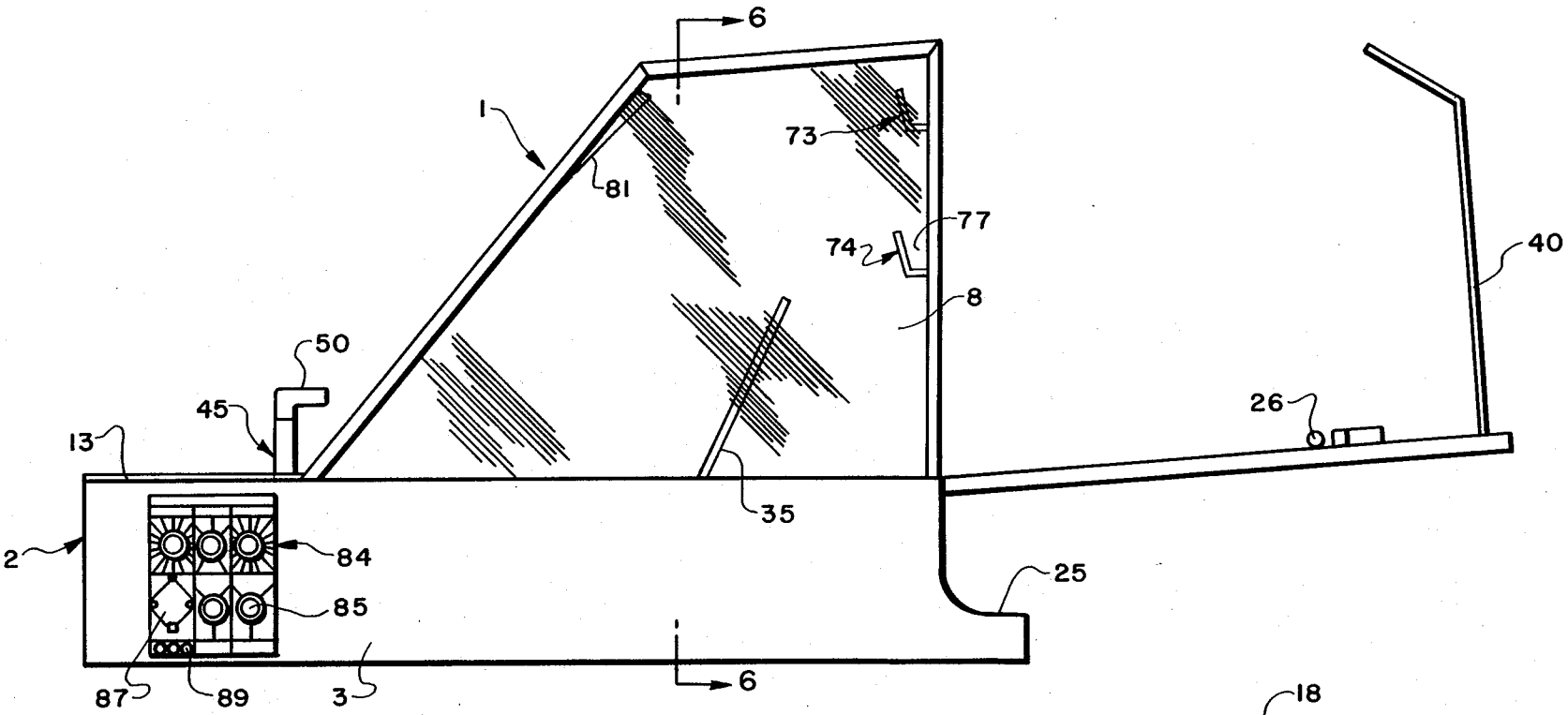
FIG. 2 is a side elevational view of the baseball game shown in FIG. 1.
Figure 7:
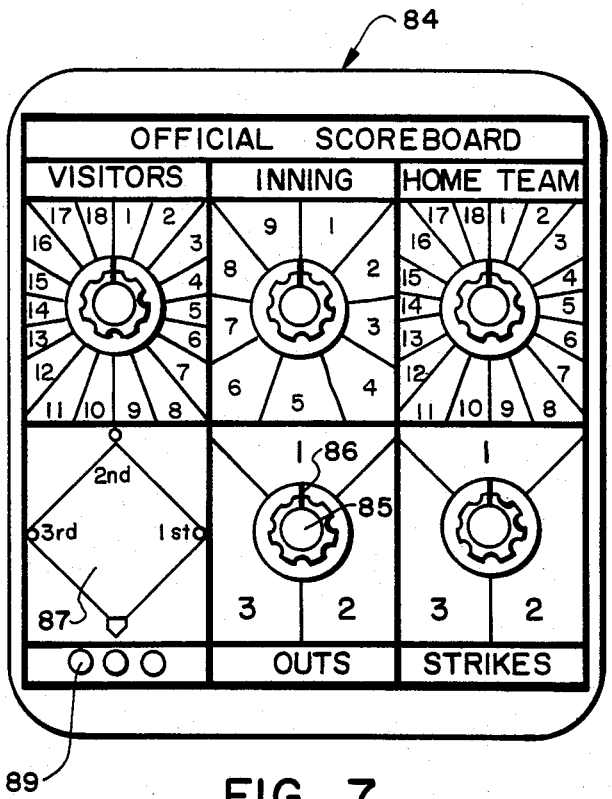
FIG. 7 is an enlarged plan view of the scoreboard component of the baseball game looking in the direction of arrows 7—7.

Another feature of the improved baseball game is the mounting of the score board indicated generally at 84, on side wall 3 of base 2 (FIGS. 2 and 7). Score board 84 includes a plurality of rotatable dials 85 mounted at space locations on the board having an indicator 86 which is adapted to register with a selected number to indicate either the score of the home team or visitors, the particular inning, and "balls" and "strikes" presently on the batter. A simulated baseball diamond 87 also may be provided with a hole 88 at each of the base positions for receiving an indicating marker or peg 89, three of which are removably mounted in openings adjacent the simulated baseball diamond. Score board 84 provides a constant indication of the score, inning and pitch count on the batter, and position of any base runners. It can be controlled easily by the batter with one hand after each pitch without requiring him or the pitcher to lose concentration or consume consideration time to distract from the playing of the game. Other types of score boards can be devised which are mounted either directly on or separated from the game base without affecting the concept of the invention. However, the score board shown in the drawings is believed to preform extremely satisfactory for the intended purpose.

Although the game is intended for two people a number of other persons can play by dividing the people into teams with each player taking a turn as a pitcher and batter.

It has been found that a ball 26 can be propelled with a velocity approaching 95 mph by proper manipulation of pitching wand 82. As shown diagrammatically in FIG. 16, wand 82 has a flat bottom surface 90 which is slid rapidly along the surface of panel 30 as shown by arrow A by a whipping or flipping action of a players wrist indicated at 91. Wand 82 has a ball striking or front surface 93 which extends perpendicularly upwardly from bottom surface 90 for striking ball 26 and propelling it through enclosure panel rearwall opening 39 and then through ramp opening 38 as the ball continues to roll along panel 28 toward home plate 46. Wand 82 preferably is formed of a hard plastic material and can be covered with a resilient or sound deadening rubber or felt material.

Improved baseball game 1 provides a parlor type game which can be mounted on a table top or can be self-supported by attaching legs to the base 2. It also can be played within an individual's home or at public locations in which a coin operated slide mechanism can be incorporated into the base for releasing the balls to the players. An important feature of the game is that it can be played without any possible damage to the surrounding area or injury to the players even though the ball is pitched and batted at extremely high velocities since the batted ball remains at all times within the protective enclosure 7. The only possibility in which a ball could leave enclosure 7 would be that a batted ball is projected through ramp opening 38 and rear panel opening 39 which would be rare due to the inclined front surface 33 of mounting block 31 which would project any such hit ball upwardly into the enclosed area. However, even if such a ball would follow such a path out of enclosure 7 it would strike the pitcher's shield 40 preventing any possible injury to the player.

Accordingly, the improved baseball game construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved baseball game is constructed and used, the characteristics of the construction, and the advantageous, new and useful results obtained; the new and useful structures, devices, elements, arrangements, parts, and combinations, are set forth in the appended claims.

What is claimed is:

1. A baseball game adapted to be played by two players, including:

(a) a base;

(b) a generally transparent enclosure mounted on the base;

(c) inclined surface means mounted on the base and extending upwardly outwardly beyond the enclosure for forming a ball delivery path and a pitching station at an outer end thereof;

(d) a pivotally mounted bat located adjacent an inner end of the inclined surface means adapted to be manually moved by one of the players for striking a ball propelled by the other player;

(e) a ball adapted to be propelled by the other player from the pitching station along the ball delivery path of the inclined surface means toward the bat;

(f) a hand manipulated wand adapted to be operated by said other player for propelling the ball toward the bat;

(g) a plurality of elevated ball receiving compartment means located within the enclosure for capturing a batted ball, with certain of the compartments designating a particular type of a hit;

(h) ramp means located within the enclosure for directing a ball struck by the bat upwardly toward the compartments; and (i) a transparent shield extending upwardly from the extended end of the inclined surface means for protecting said other player from being struck by a batted ball.

2. The baseball game defined in claim 1 in which the hand manipulated ball propelling wand is an elongated member having a flat bottom surface adapted to slidably engage the inclined surface means and a ball striking surface extending generally perpendicularly upwardly from and said bottom surface.

3. The baseball game as defined in claim 2 in which the wand is formed of a high strength plastic.

4. The baseball game defined in claim 1 in which the bat has a pivot shaft telescopically pivotally mounted in a hub mounted on the inclined surface means; and in which a ball striking portion extends perpendicularly horizontally outwardly from said pivot shaft.

5. The baseball game defined in claim 4 in which the pivot shaft is formed of stainless steel and the hub formed of plastic to provide a low friction engagement therebetween.

6. The baseball game defined in claim 1 in which a stop is located in the pivotal movement path of the bat to prevent complete rotation of the bat when manipulated by the first player.

7. The baseball game defined in claim 6 in which the stop includes a vertical shaft adapted to be removably mounted in a hub mounted on the inclined surface means; and in which an upper portion of the shaft has a resilient cover to absorb the shock when being struck by the bat in preventing complete rotation of said bat.

8. The baseball game defined in claim 1 in which the bat is removably mounted on the inclined surface means on both sides of the ball delivery path to simulate both a left and right hand batter.

9. The baseball game defined in claim 1 in which backstop means is located adjacent to and spaced from the inner end of the inclined surface means for indicating that a pitched unbatted ball is either a ball or strike.

10. The baseball game defined in claim 9 in which the backstop means includes a strike plate which is struck by a pitched ball after passing through a strike zone adjacent the bat to produce sound to indicate that the pitched ball was a strike.

11. The baseball game defined in claim 10 in which the base includes a bottom wall sloped in an opposite direction than the inclined surface means; in which the inclined surface means is mounted above the bottom wall; in which a pitched ball that strikes the backstop means is deflected by said backstop means onto the bottom wall whereupon it rolls into a ball collection area adjacent the pitching station; and in which the strike plate is a metal plate which is mounted at an angle to deflect balls striking said plate toward the bottom wall.

12. The baseball game defined in claim 1 in which the enclosure is formed by a plurality of panels of a high strength plastic, certain of which are removably attached to each other enabling the enclosure panels to be dismantled for compact storage.

13. The baseball game defined in claim 1 in which the inclined surface means includes a first panel having a relatively smooth flat surface located within the enclosure and a second panel having relatively smooth flat surface extending outwardly from within the enclosure to the pitching station located externally of said enclosure.

14. The baseball game defined in claim 1 in which the enclosure includes at least top, side and rear walls; in which the ball receiving compartment means include at least two compartments each having a bottom wall extending outwardly from and mounted on the enclosure rear wall and terminating in an upwardly extending front wall spaced from said rear wall forming a ball capturing space therebetween; in which each of the compartment bottom walls is formed with a hole for discharging a ball therethrough after being captured in said compartment; and in which the bottom wall of each compartment is sloped toward the ball discharge hole.

15. The baseball game defined in claim 14 in which ball deflector means is mounted on at least one of the enclosure walls for deflecting a batted ball toward the ball receiving compartments.

16. The baseball game defined in claim 1 in which the ball is spherical and is formed of solid polytetrafluoroethylene having a diameter of approximately ½ inch and weighs approximately 2.5 grams.

17. A baseball game adapted to be played by two players, including:

(a) a base;

(b) a generally transparent enclosure mounted on the base;

(c) inclined surface means mounted on the base and extending upwardly outwardly beyond the enclosure for forming a ball delivery path and a pitching station at an outer end thereof;

(d) a pivotally mounted bat located adjacent an inner end of the inclined surface means adapted to be manually moved by one of the players for striking a ball propelled by the other player; said bat having a plastic hub mounted on the inclined surface, a stainless steel pivot shaft telescopically mounted in the hub to provide a low friction engagement therebetween, and a ball striking portion extending perpendicularly horizontally outwardly from said pivot shaft;

(e) a ball adapted to be propelled by the other player from the pitching station along the ball delivery path of the inclined surface means toward the bat;

(f) a hand manipulated wand adapted to be operated by said other player for propelling the ball toward the bat;

(g) a plurality of elevated ball receiving compartment means located within the enclosure designating a particular type of a hit; and (h) ramp means located within the enclosure for directing a ball struck by the bat upwardly toward the compartments.

18. A baseball game adapted to be played by two players, including:

(a) a base having a bottom wall;

(b) a generally transparent enclosure mounted on the base;

(c) inclined surface means mounted on and above the base and extending upwardly and outwardly beyond the enclosure in an opposite direction than the bottom wall for forming a ball delivery path and a pitching station at an outer end thereof;

(d) a pivotally mounted bat located adjacent an inner end of the inclined surface means adapted to be manually moved by one of the players for striking a ball propelled by the other player;

(e) a ball adapted to be propelled by the other player from the pitching station along the ball delivery path of the inclined surface means toward the bat;

(f) a hand manipulated wand adapted to be operated by said other player for propelling the ball toward the bat;

(g) a plurality of elevated ball receiving compartment means located within the enclosure for capturing a batted ball, with certain of the compartments designating a particular type of a hit;

(h) ramp means located within the enclosure for directing a ball struck by the bat upwardly toward the compartments;

(i) a ball collection area located adjacent the pitching station; and (j) backstop means located adjacent to and spaced from the inner end of the inclined surface means for indicating that a pitched unbatted ball is either a ball or strike; whereby a pitched ball that strikes the backstop means is deflected by said backstop means onto the bottom wall whereupon it rolls into the ball collection area, said backstop means including a metal strike plate which is struck by a pitched ball after passing through a strike zone adjacent the bat to produce a sound to indicate that the pitched ball is a strike, said strike plate being mounted on an angle to deflect balls striking the plate toward the bottom wall.

19. A baseball game adapted to be played by two players, including:

(a) a base;

(b) a generally transparent enclosure mounted on the base;

(c) inclined surface means mounted on the base and extending upwardly outwardly beyond the enclosure for forming a ball delivery path and a pitching station at an outer end thereof; said inclined surface means including a first panel having a relatively smooth flat surface located within the enclosure and a second panel having a relatively smooth flat surface extending outwardly from within the enclosure to the pitching station located externally of the enclosure;

(d) a pivotally mounted bat located adjacent an inner end of the inclined surface means adapted to be manually moved by one of the players for striking a ball propelled by the other player;

(e) a ball adapted to be propelled by the other player from the pitching station along the ball delivery path of the inclined surface means toward the bat;

(f) a hand manipulated wand adapted to be operated by said other player for propelling the ball toward the bat;

(g) a plurality of elevated ball receiving compartment means located within the enclosure for capturing a batted ball, with certain of the compartments designating a particular type of a hit; and (h) ramp means located within the enclosure for directing a ball struck by the bat upwardly toward the compartments.

20. The baseball game defined in claim 19 in which the ramp means includes a ramp having a smooth inclined surface mounted on the inclined surface means adjacent the junction of the first and second panels and extending upwardly rearwardly toward a rear wall of the enclosure.

21. The baseball game defined in claim 20 in which the ramp and rear wall of the enclosure means are formed with opening means adjacent the inclined surface means for forming passages for a ball propelled by the pitching wand toward the bat.

22. The baseball game defined in claim 19 with which the first and second panels extends at angles of approximately $3\frac{1}{2}°$ and $4\frac{1}{2}°$, respectively, with respect to the horizontal.

23. A baseball game adapted to be played by two players, including:

(a) a base;

(b) a generally transparent enclosure mounted on the base;

(c) inclined surface means mounted on the base and extending upwardly outwardly beyond the enclosure for forming a ball delivery path and a pitching station at an outer end thereof;

(d) a pivotally mounted bat located adjacent an inner end of the inclined surface means adapted to be manually moved by one of the players for striking a ball propelled by the other player;

(e) a spherical ball formed of solid polytetrafluoroethylene having a diameter of approximately $\frac{1}{2}$ inch and weighing approximately 2.5 grams adapted to be propelled by the other player from the pitching station along the ball delivery path of the inclined surface means toward the bat;

(f) a hand manipulated wand adapted to be operated by said other player for propelling the ball toward the bat;

(g) a plurality of elevated ball receiving compartment means located within the enclosure for capturing a batted ball, with certain of the compartments designating a particular type of a hit; and (h) ramp means located within the enclosure for directing a ball struck by the bat upwardly toward the compartments.

24. A baseball game adapted to be played by two players, including:

(a) a base (b) a generally transparent enclosure mounted on the base; having at least top, side and rear walls;

(c) inclined surface means mounted on the base and extending upwardly outwardly beyond the enclosure for forming a ball delivery path and a pitching station at an outer end thereof;

(d) a pivotally mounted bat located adjacent an inner end of the inclined surface means adapted to be manually moved by one of the players for striking a ball propelled by the other player;

(e) a ball adapted to be propelled by the other player from the pitching station along the ball delivery path of the inclined surface means toward the bat;

(f) a hand manipulated wand adapted to be operated by said other player for propelling the ball toward the bat;

(g) a plurality of elevated ball receiving compartment means located within the enclosure for capturing a batted ball, with certain of the compartments designating a particular type of a hit, said ball receiving compartment means including at least two compartments each having a bottom wall extending outwardly from and mounted on the enclosure rear wall and terminating in an upwardly extending front wall spaced from said rear wall forming a ball capturing spaced therebetween, and a hole formed in the bottom wall of each compartment for discharging a ball therethrough after being captured in the compartment with part of said bottom walls being sloped toward the ball discharge hole;

(h) ramp means located within the enclosure for directing a ball struck by the bat upwardly toward the compartments; and (i) ball deflection means mounted on at least one of the enclosure walls for deflecting a batted ball toward the ball receiving compartments.

* * * * *